United States Patent [19]

Lee

[11] Patent Number: 4,941,579

[45] Date of Patent: Jul. 17, 1990

[54] AUXILIARY DEVICE FOR A NURSING BOTTLE

[76] Inventor: Hwang-Sheng Lee, 84, Fl., 6-3, Sec. 3, San-Min Rd., Taichung, Taiwan

[21] Appl. No.: 336,420

[22] Filed: Apr. 11, 1989

[51] Int. Cl.[5] ..... A61J 9/00; A61J 9/06; A47G 23/02

[52] U.S. Cl. ..... 215/11.1; 215/100 A; 220/94 R; 220/94 A; 248/102; 294/27.1; 294/31.2

[58] Field of Search ..... 215/100 A, 11.1, 11.6, 215/100 R; 248/102, 103, 109, 105, 107; D24/45–48; 220/85 H, 94 R; 294/27.1, 31.2, 33, 34

[56] References Cited

U.S. PATENT DOCUMENTS

| | | | |
|---|---|---|---|
| D. 298,970 | 12/1988 | Dirks | D24/48 |
| 622,862 | 4/1899 | Pierce | 215/100 A X |
| 626,262 | 6/1899 | Wright | 215/100 A |
| 1,188,904 | 6/1916 | Cosgriff | 215/11.6 X |
| 1,428,758 | 9/1922 | Cowles | 215/11.6 |
| 1,429,198 | 9/1922 | Fawcett | 215/11.6 |
| 2,310,515 | 2/1943 | Chester | 215/11.6 X |
| 2,550,210 | 4/1951 | Vance, Jr. | 215/11.1 X |
| 3,058,708 | 10/1962 | Murray et al. | 248/102 |
| 3,718,360 | 2/1973 | Knutzen | 215/11.6 X |
| 3,773,287 | 11/1973 | Hechinger | 248/102 |
| 3,963,206 | 6/1976 | Scolaro et al. | 248/105 |
| 3,990,596 | 11/1976 | Hoftman | 215/11.1 |
| 4,723,801 | 2/1988 | Masumeci et al. | 248/102 X |

FOREIGN PATENT DOCUMENTS

| | | | |
|---|---|---|---|
| 277511 | 9/1913 | Fed. Rep. of Germany | 215/100 A |
| 3021110 | 12/1981 | Fed. Rep. of Germany | 248/104 |

*Primary Examiner*—Sue A. Weaver
*Attorney, Agent, or Firm*—Bacon & Thomas

[57] ABSTRACT

An auxiliary device is provided on a nursing bottle and includes a plurality of plastic strips extending from the upper portion of the bottle to the lower portion of the bottle so that any two of the strips can be held by the hands of a baby. Each of the strips has a generally horizontal portion extending radially and outwardly from the upper portion of the bottle, and an inclined generally straight portion extending from the outer end of the horizontal portion to the container. When the bottle comes in contact with the ground, the bottle is supported by some of the strips in such a manner that the nipple and the mouth of the container are tilted upward.

4 Claims, 6 Drawing Sheets

AUXILIARY DEVICE FOR A NURSING BOTTLE

BACKGROUND OF THE INVENTION

This invention relates to a nursing bottle, more particularly to a baby-graspable auxiliary device therefor, whereby bottle breakage and leakage of the liquid contained within the bottle can be prevented.

When a mother bottle-feeds her baby, she must hold the baby with one hand and grasp the nursing bottle with the other hand. Accordingly, a mother's hands are not free to deal with urgent matters such as receiving a telephone call while she is bottle-feeding her baby. If a baby could hold a nursing bottle itself, this problem would be solved. The hands of a very small infant, however, are too small to hold an ordinary nursing bottle. Therefore, it is desirable that a nursing bottle be equipped with an auxiliary device which can be held by such an infant. However, when held by a baby, the chances that a nursing bottle will be thrown to the ground or against a hard surface are greatly increased. In this case, not only will the liquid contained within the bottle escape, but the bottle itself may also be damaged.

SUMMARY OF THE INVENTION

It is therefore the main object of this invention to provide a baby-graspable auxiliary device, for a nursing bottle whereby the breaking of the bottle and the escape of liquid from the same can be prevented when said bottle hits the ground or other hard surface.

According to this invention, an auxiliary device is provided on a nursing bottle. The nursing bottle includes a container of a liquid with a mouth provided at the upper end of the container, a rubber nipple, and an annular anchoring member threadedly engaged with said container so as to secure the nipple onto the upper end of the container. The auxiliary device includes a plurality of plastic strips extending from the outer surface of the upper portion of the bottle to the outer surface of the lower portion of the bottle so that any two of the strips can be held by the hands of a baby. Each of the strips has a generally horizontal portion extending radially and outwardly from the upper portion of the bottle, and an inclined and generally straight portion extending from the outer end of the horizontal portion to the container. When the bottle comes in contact with the ground, the bottle is supported by some of the strips in such a manner that the nipple and the mouth of the container are tilted upward

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
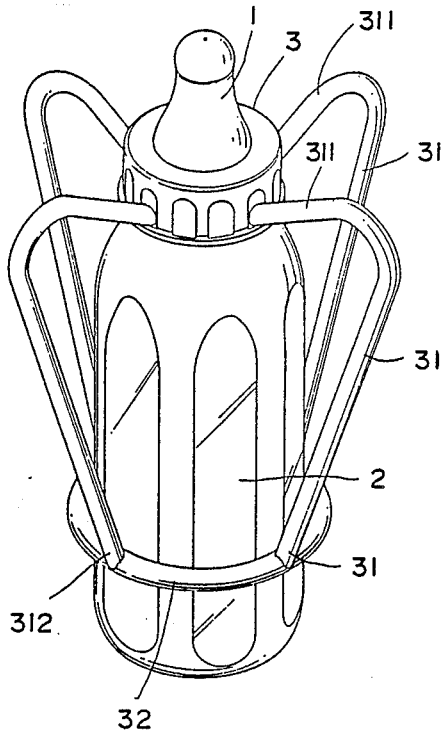
FIG. 1 is an assembled view of a nursing bottle equipped with an auxiliary device according to a first embodiment of this invention.
Figure 2:
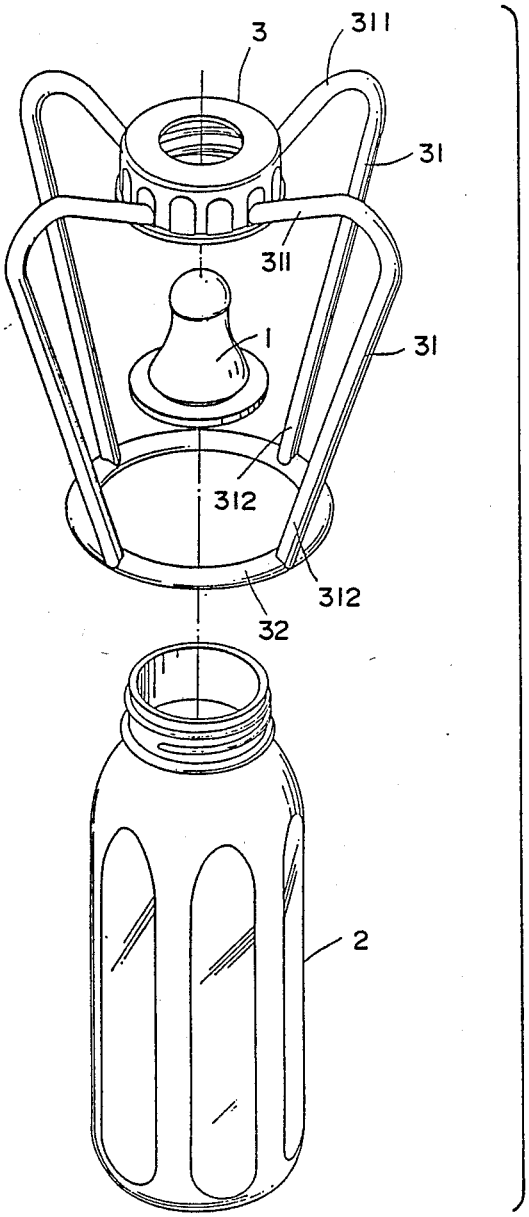
FIG. 2 is an exploded view of the nursing bottle equipped with the auxiliary device according to the first embodiment of this invention.

Referring to FIGS. 1 and 2, an auxiliary device of this invention is specifically used on a nursing bottle which has a rubber nipple 1, a plastic milk container 2 with a mouth provided on the upper end thereof, and a plastic anchoring member 3 threadedly engaged with the container 2 so as to secure the nipple 1 onto the upper end of the container 2.

The auxiliary device includes four equally spaced-apart parallel plastic strips 31 and a plastic lower ring 32 integrally formed with the lower end of the strips 31. Each of the strips 31 has a generally horizontal portion 311 extending radially and outwardly from the anchoring member 3, and an inclined and generally straight portion 312 extending from the outward end of the horizontal portion 311 to the lower ring 32. The lower ring 32 is sleeved tightly on the lower portion of the container 2.

Figure 3:
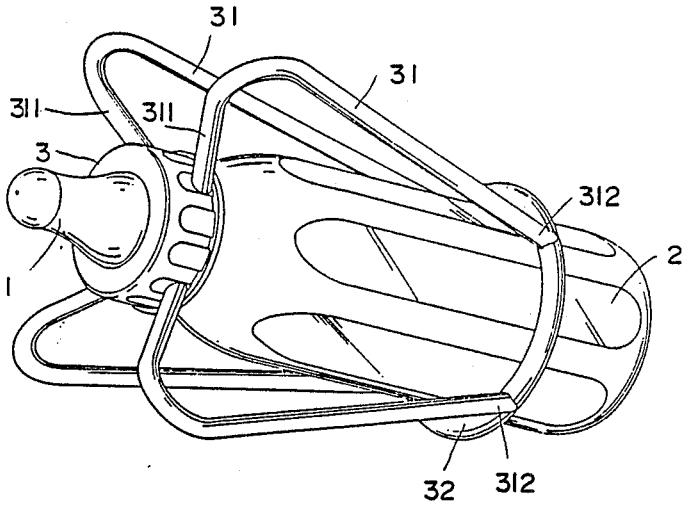
FIG. 3 is a schematic view illustrating the position of the nursing bottle when it comes in contact with the ground in accordance with the first embodiment of this invention.

Referring to FIG. 3, when the bottle comes in contact with the ground, the container 2 is supported by some of the strips 31 in such a manner that the nipple 1 and the mouth of said container 2 are always tilted upward. Accordingly, the container 2 cannot be broken, nor can the liquid contained therein escape.

Figure 4:
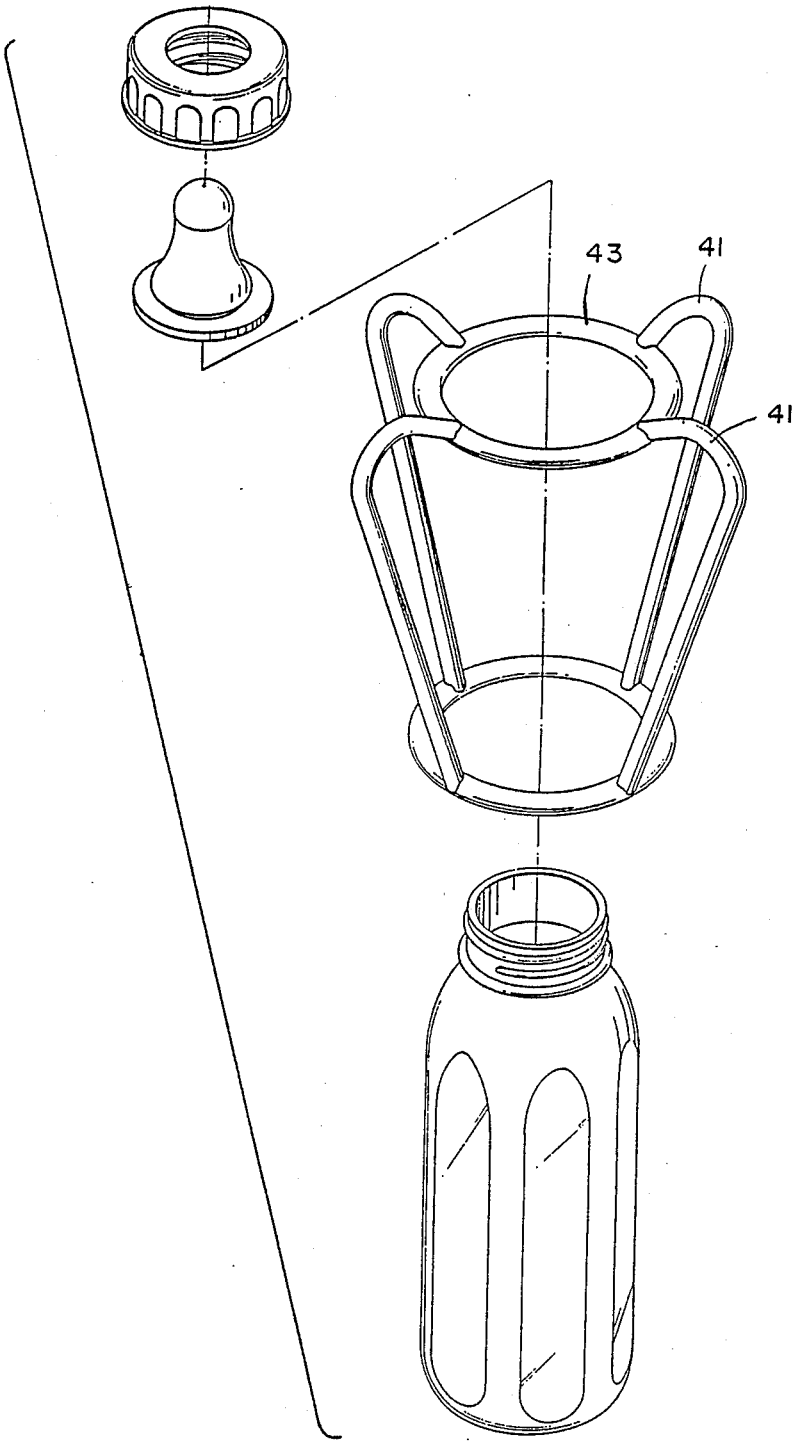
FIG. 4 is an exploded view of a nursing bottle equipped with an auxiliary device according to a second embodiment of this invention.
Figure 5:
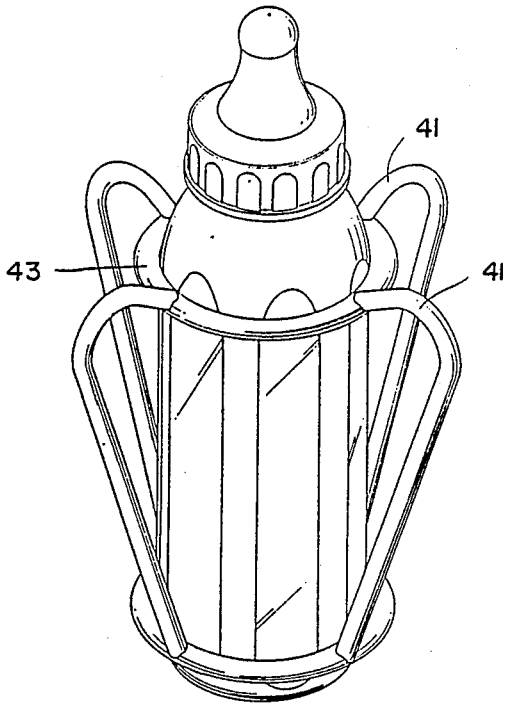
FIG. 5 is an assembled view of the nursing bottle equipped with the auxiliary device according to the second embodiment of this invention.
Figure 6:
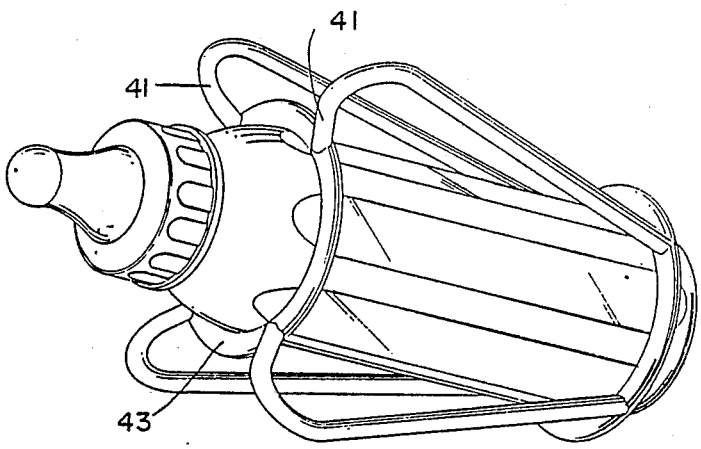
FIG. 6 is a schematic view illustrating the position of the nursing bottle when it comes in contact with the ground in accordance with the second embodiment of this invention.

Referring to FIGS. 4–6, another auxiliary device of this invention is similar in construction to the first embodiment except that the strips 41 extend from a plastic upper ring 43 rather than the nipple. The upper ring 43 is integrally formed with the horizontal portions of the strips 41 and is sleeved tightly on the upper portion of the container 2 . This arrangement can also achieve the same object as the first embodiment.

With this invention thus, explained, it is apparent that numerous modifications and variations can be made without departing from the scope and spirit of this invention. It is therefore intended that this invention be limited only as indicated in the appended claims.

I claim:

1. An auxiliary device for a nursing bottle, said nursing bottle including a container for liquid with a mouth provided at an upper end of said container, a nipple, and an annular anchoring member for threaded engagement with said container so as to secure said nipple onto said upper end of said container, said auxiliary device including a plurality of plastic strips extending from an outer surface of an upper portion of said bottle to an outer surface of a lower portion of said bottle so that any one of said strips can be grasped by a hand of a baby, each of said strips has a generally horizontal portion extending radially and outwardly from said upper portion of said bottle, and an inclined generally straight portion extending from an outer end of said horizontal portion inwardly to the lower portion of said bottle and the strips being sufficient in number so that at least two of said strips are always engageable with a horizontal surface for supporting the nipple and mouth of the container in an upwardly tilted disposition to prevent leakage of liquid from the container.

2. An auxiliary device as claimed in claim 1, further comprising a lower ring which is integrally formed with lower ends of said strips and is sleeved tightly on a lower portion of said container, said horizontal portions of said strips extending radially and outwardly from said anchoring member.

3. An auxiliary device as claimed in claim 1, further comprising an upper ring and a lower ring, said upper ring being sleeved tightly on an upper portion of said container, said lower ring being sleeved tightly on a lower portion of said container, said horizontal portions of said strips being integrally formed with said upper ring at inner ends thereof , said straight portions of said strips being integrally formed with said lower ring at lower ends thereof.

4. An auxiliary device as claimed in claim 1, including four equally spaced-apart said strips which are parallel to one another.

* * * * *